United States Patent [19]

Belas et al.

[11] 4,004,789

[45] Jan. 25, 1977

[54] TUNNELIZED BURNER FOR PANEL TYPE FURNACE

[75] Inventors: John J. Belas, Baltimore; Leonard P. Pellatiro, Glen Arm, both of Md.

[73] Assignee: Bethlehem Steel Corporation, Bethlehem, Pa.

[22] Filed: Feb. 5, 1975

[21] Appl. No.: 547,306

[52] U.S. Cl. ..... 266/87; 266/103

[51] Int. Cl.[2] ..... C21D 9/56

[58] Field of Search ..... 266/3 R, 5 T, 102, 103, 266/87; 431/90, 353; 432/8, 59

[56] References Cited

UNITED STATES PATENTS

| | | | |
|---|---|---|---|
| 2,668,701 | 2/1954 | Dietrich | 432/8 |
| 2,933,425 | 4/1960 | Hess | 266/3 R X |
| 3,459,410 | 8/1969 | Uban | 432/8 X |
| 3,476,494 | 11/1969 | Buchanan et al. | 431/353 |
| 3,496,033 | 2/1970 | Gilbreath et al. | 266/3 R X |
| 3,666,393 | 5/1972 | Davies | 431/90 |
| 3,809,525 | 5/1974 | Wang et al. | 431/353 |
| 3,868,094 | 2/1975 | Hovis | 266/5 T |

*Primary Examiner*—W. Tupman
*Assistant Examiner*—Paul A. Bell
*Attorney, Agent, or Firm*—Joseph J. O'Keefe; William B. Noll

[57] ABSTRACT

Heating apparatus for a continuous moving strand characterized by a plurality of pairs of opposed spaced apart heating panels between which said strand is caused to move, where at least one of said panels consists of a single burner recessed from the panel wall adjacent the moving strand.

8 Claims, 2 Drawing Figures

ZONE 4 CONTROLLER
ZONE 3 CONTROLLER (TYPICAL)
ZONE 2 CONTROLLER
ZONE 1 CONTROLLER
MASTER CONTROLLER
COMBUSTION AIR
DIFF. PRESS. TRANS-MITTER
MAN. AUTO. CONTROL STATION
NATURAL GAS
10
12
14
15
15a
15b
15c
16
16a
18
24
26
32
34
36
38
40
42
44
S

AIR
GAS
16
18
20
21
22
24
26
27
29
31

TUNNELIZED BURNER FOR PANEL TYPE FURNACE

BACKGROUND OF THE INVENTION

This invention relates to strand heating furnaces, or more particularly to improvements in the strand heating mechanism of a panel type furnace, such as illustrated and described in U.S. Pat. No. 2,869,846 to Bloom.

Panel type furnaces have achieved a high degree of acceptance in the steel industry due to their general convenience and reliability. Such furnaces have been used to heat steel strip moving in a fixed path continuously at speeds up to several hundred feet per minute. The furnaces typically comprise one or more pairs of oppositely disposed panels provided with radiant gas burners. As exemplary prior art panel measures about 4 feet by 5 feet and contains 30 burners arranged in five rows with six burners each.

While such furnaces and the related line equipment were designed for continuous operation, it is necessary, often frequently, to shut down the operation for threading broken strips, maintenance, repairs and other malfunctions. To facilitate such work in and around the furnace, means were provided for moving the furnace sideways to a position away from the fixed path of the strip. The construction and description of one such means is set forth in the Bloom patent noted earlier. Additionally, the art of panel type furnaces has progressed further with the addition of improved air seals, improvements in refractory materials, improved designs for the interchangeability or replacement of panels, and to various means for controlling heat loss from the furnace.

The present invention relates to a further improvement in the art of panel type furnaces and is compatible with and used in conjunction with each or all of the improvements noted above. This invention relates to one area which has received little attention as a potential area for improvement, for, practitioners in the art believed an array of burners was needed to insure sufficient heating of the rapidly moving steel strip. Perhaps the apparent absence of concern for conserving energy or fuel may have misled such practitioners to the conclusion that multiple burners were the only answer, and that an array of burners was the most efficient and practical method of heating the steel strip.

Through improved maintenance control and fuel consumption, it was discovered that each exemplary feature below could be achieved, along with improved product quality and quantity of material processed, by the newly designed and operated furnace panel of this invention. For example, by the addition of the furnace panel of this invention to the strip heating mechanism of a hot dip coating line, product quality was improved, the quantity of coated steel produced was increased, the fuel consumption per ton of steel heated was lowered, and the level and extent of maintenance required to operate the heating mechanism was lowered. Such improvements will become apparent from a reading of the description to follow.

SUMMARY OF THE INVENTION

This invention is directed to improvements in the construction and operation of a panel type furnace used in heating a continuous metallic strand moving in a vertical path. The improvements reside in the design of the panel which utilizes a single flat flame burner which is recessed in the panel. An apt descriptive term for the burner of this invention would be a "tunnel burner". The construction is such that the burner is recessed from the face of the panel and the flame from the burner is directed through a refractory lined passage or tunnel in the brickwork and concentrated on the moving strip passing adjacent to the face of the panel. This arrangement puts more heat into the strip without overheating the furnace sidewalls or panel faces, which under prior construction concepts could reach temperatures on the order of 2800° F.

In addition to the novel design of the burner panel itself, there have been further changes imposed on the combustion support equipment used in conjunction therewith. For instance, the burner panel of this invention uses a nozzle mixed fuel, as opposed to a premixed fuel. That is, the combustible fuel such as natural gas and the air to be mixed therewith are fed to the burner through separate piping systems. By mixing in the nozzle it is possible to eliminate most of the premixed combustion equipment and still have a safe operation without costly safety equipment and fire checks. The nozzle mixed gases continue to react after discharge from the burner into the tunnel. This tunnel concentrates the heat developed, which may be as high as 3200° F, into the sheet without overheating the furnace sidewalls or panel faces. The increased length of time in which the gases have to mix and burn completely assures the removal by combustion of all of the oxygen, and the maintenance of a metallurgically reducing or non-oxidizing atmosphere in the furnace about the strip.

DETAILED DESCRIPTION OF PREFERRED EMBODIMENT

Figure 1:
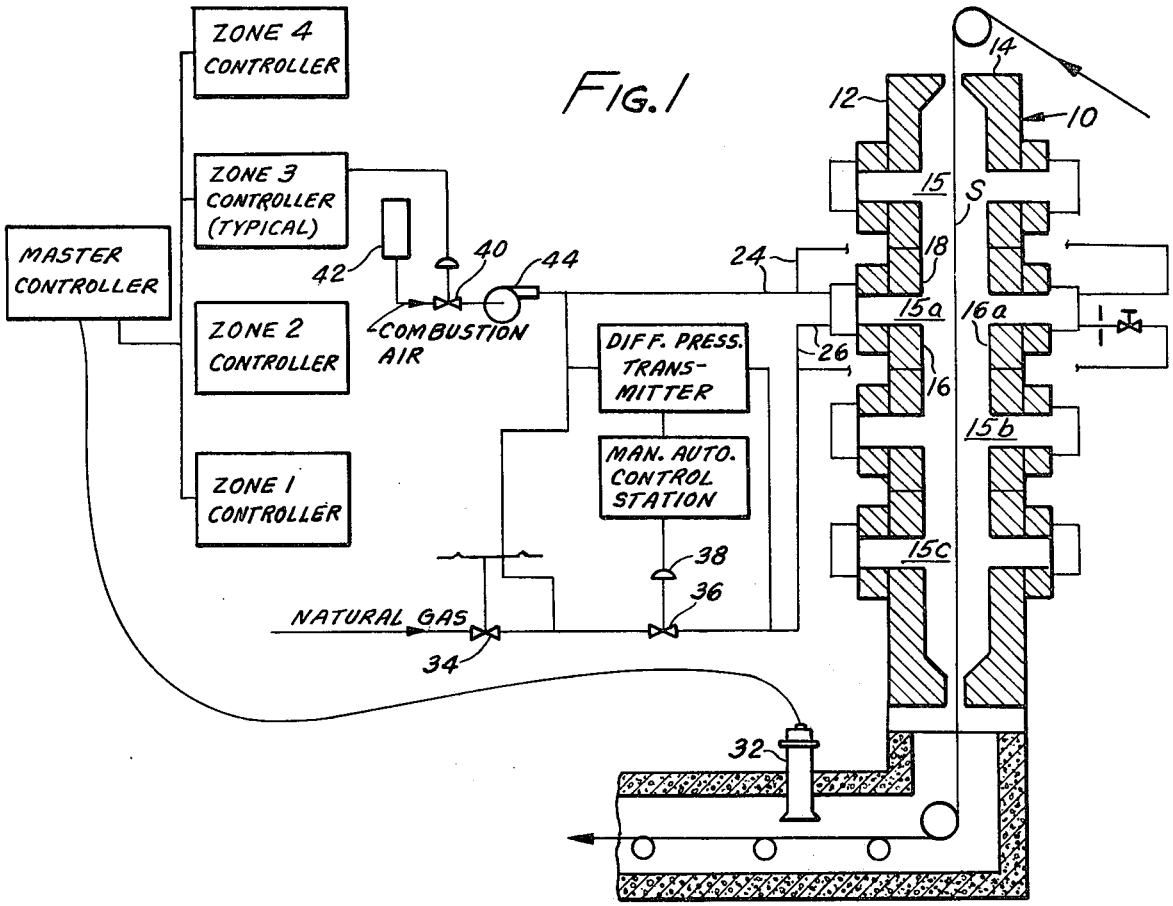
FIG. 1 is a transverse schematic sectional view of heating apparatus for a continuous moving strand containing the novel burner panels, along with exemplary supporting equipment, arranged and constructed according to the teaching of this invention.

Referring to the drawings, particularly FIG. 1, there is illustrated a panel type vertical furnace 10 for heating a metallic strand 5 passing therethrough. The furnace 10 comprises essentially two members 12 and 14 which cooperate to form one or more heating zones. For convenience, four zones 15, **15*a*, 15*b*, 15*c* have been illustrated in FIG. 1. Each zone, such as 15*a* is formed by oppositely disposed heating panels 16 and 16*a***. The joining of such panels to adjacent structural supports, and the general mobility of the panels to the fixed path of the strip passing through the heating zones will not be detailed in this specification as such features are known per se. Nevertheless, to gain a further appreciation of the details of a panel type furnace, reference may be made to said Bloom patent noted earlier.

As indicated previously, the invention herein is directed to the novel construction and operation of burner panels 16, **16*a***. Consequently, the further description will be limited to detailing of such construction and operation. Finally, while the present invention has found utility in the heating furnace of a hot dip coating line, this should not be read as a limitation thereof for it is clearly useful for the general heating of a continuous metallic strip.

Figure 2:
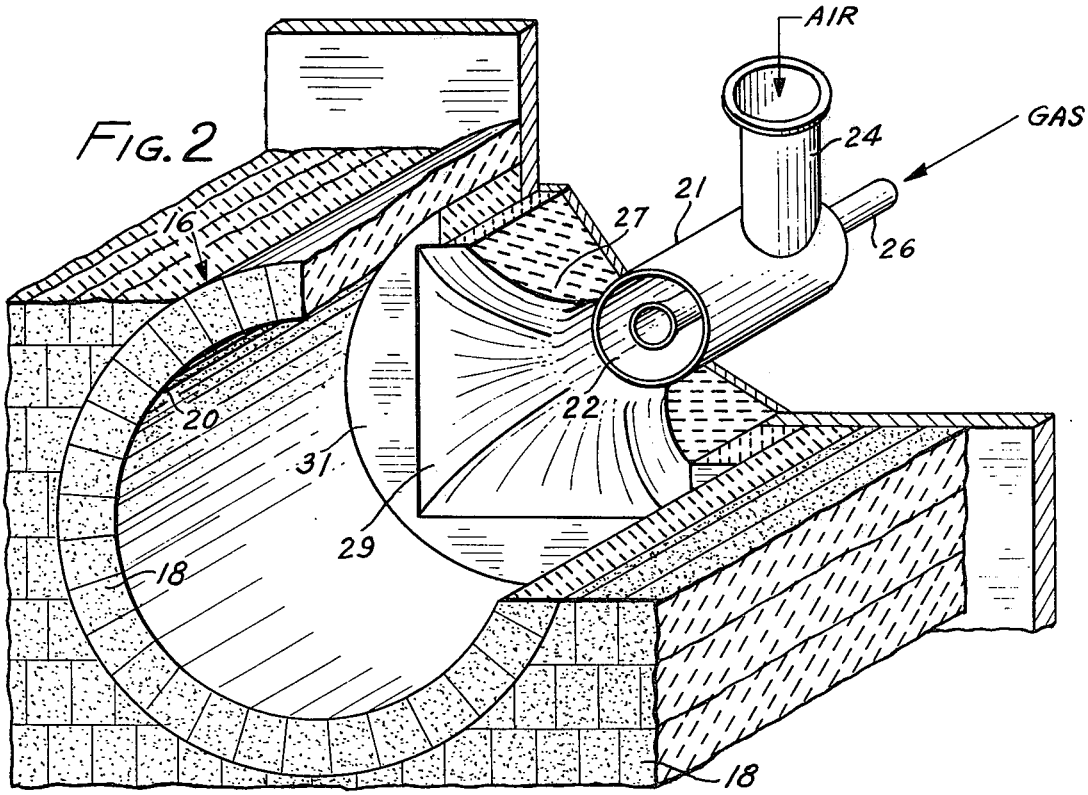
FIG. 2 is an enlarged perspective view of a burner panel used in the apparatus of FIG. 1, with parts removed to reveal details thereof.

With this brief background, attention may now be directed to the specific burner panel 16 shown in FIG. 2. The burner panel is characterized by a forward face 18 which surrounds and defines a tunnel or central passage 20. At the end of the tunnel remote from said face 18, there is provided a burner 21. The burner 21, in its simplest form, comprises a nozzle 22, and fuel component feeding pipes 24 and 26.

The burner 21 is surrounded by a ceramic burner block 27 which is characterized by a cone shaped throat 29 diverging from the nozzle 22 and blending with the forward face 31 of burner block 27. Such burners are known per se and are manufactured by North American Manufacturing Co., Cleveland, Ohio, and may be identified as "Flat Flame Burners" Series 4832. For the dimensions and detailed operating characteristics of such burners, reference may be made to Bulletin 48.32 (3-70) as published by North American Manufacturing Co.

Since each burner 21 is designed to heat the strand over substantially its full width, without at the same time overheating the strand edges, or having the flame directly impinge on the strand surface, the optimum width or diameter of the central passage 20 should be about 60% of the strand width, or broadly about 40 to about 80% thereof. The distance between the burner nozzle 22 and the moving strand will depend on two factors, i.e. proximity of the strand or strip to face 18 and the total depth of the central passage and throat 29. The former will generally be fixed by the construction of the furnace relative to the fixed path of the moving strip. The distance, which may vary between about 5 to about 10 inches, typically about 7 inches, must be adequate so as to avoid overheating of the strip, yet it can not be too great and jeopardize the chemically reducing conditions which are necessary for certain heat treating operations. An optimum arrangement for the preheating of a strip prior to hot dip coating, was found using a distance of about 7 inches from strip to forward face 18, a central passage 20 having a length of about 11 inches, a burner block throat depth of 7 inches, or a total distance of about 25 inches from the strip to the burner nozzle 22.

The burner or burners of this invention operate more efficiently and give better control of the heating of a moving strip than the array of pre-mix burners used in prior art furnaces. By the use of separate piping systems 26 and 24 respectively, for the fuel, i.e. natural gas, and air, for mixing in the nozzle 22, lower pressures may be used which means a low forward velocity for the flame. This characteristic insures that the flame will not impinge on the moving strip. The mixed gases continue to react after discharge from the burner in the refractory tunnel or central passage 20, which concentrates the heat developed into the strip without overheating the furnace sidewalls or forward face 18 of the heating panels. The increased length of time that the gas and air have to mix and burn removes the oxygen present, thereby maintaining a metallurgically reducing condition in the furnace.

The combustion control system for the burner panels of this invention comprises a temperature controlled air delivery system and a combustion air pressure controlled gas delivery system. A strip temperature pyrometer or sensing device 32, which monitors the strip's temperature, is the primary mechanism which controls the flow of combustion air to the burner through piping 24.

The quantity of fuel supplied to the burner through piping 26 is regulated with a self contained pressure regulator 34 which holds constant the differential between the air and fuel pressures. This differential, once established for a given zone 15, keeps the air/fuel ratio constant throughout the flow range of the system. An automatic control valve 36 trims this regulated fuel pressure to exactly match the air pressure. When richer or leaner air/fuel ratios are desired, a manual control 38 is provided for such changes. The control valve 36 in turn responds to such change to establish a new air/fuel ratio for the burner. A final element to the system is a suction control valve 40 between the combustion air intake filter 42 and the combustion air blower 44. Such control valve 40 allows a greater turndown, i.e. reduction in air pressure and quantity of air supplied to the burner, while keeping the blower 44 from surging.

Before discussing the operation of the combustion control system it will be understood that certain operations of the furnace may dictate that each heating zone 15 operate under different air/fuel ratios. For example, in U.S. Pat. No. 3,492,378 to Simoncic, assigned to the assignee herein, there is taught a method for operating a multi-zoned panel type heating furnace. During such operations the burners in the lower zones of the furnace are fired with an air/fuel mixture having a deficiency of oxygen. With no excess oxygen such zones are metallurgically reducing to the moving strip passing therethrough. The burners in the upper zone of the furnace are fired with an air/fuel mixture having an excess of oxygen. This results in a slightly oxidizing condition. By analysis of the fuel and chemically balancing, one can readily determine the proper stoichiometric mixture of oxygen and fuel needed for complete combustion. With natural gas, an air/fuel ratio of about 10/1 will give complete combustion. Recognizing that varying conditions may be desired in the several zones of the furnace, separate combustion control systems are provided for each zone. For convenience, only one complete combustion control system has been shown in FIG. 2. Each zone is provided with a similar system, and all are under the control of "Master Controller."

In operation, the sensing device 32 continuously monitors the temperature of the strip as it exits the furnace 10. If such monitoring indicates a need for an increase or decrease in temperature, such information is picked up in the Master Controller, which feeds such information to the several "Zone Controllers". Control valve 40 responds to the requirement and increases or decreases the flow of combustion air. The "Differential Pressure Transmitter" reads the change in pressure in the combustion air line causing a change in the flow of fuel to the burner. Thus, whether the sensing device 32 calls for additional or less heat, or there is a turndown on the order of 10 to 1, the air/fuel ratio remains substantially constant. With prior art panels using a premix fuel, a turndown of any magnitude generally resulted in fuel enrichment or a drop in the air/fuel ratio. Such a problem is not found with the combustion system of this invention.

We claim:

1. Apparatus for heating a flat continuous metallic strand of a predetermined width moving in a vertical path, comprising:

a. a plurality of heating zones, each zone consisting of a set of two panels disposed in parallel relationship and spaced from one another such as to permit the vertical movement of the strand through said heating zones between each set of panels, b. at least one of said panels having a flat face portion adjacent the moving strand and a central passage that extends inwardly from said flat face portion through such panel, and c. a burner having a nozzle and a burner block surrounding said nozzle, which burner is mounted at the rear of such panel in line with said central passage, said central passage having a substantially uniform transverse cross-section from said flat face portion to said burner block and said burner block having a cone shaped throat diverging from said nozzle toward said central passage, whereby the flame produced by such burner does not impinge against the moving strand.

2. The apparatus according to claim 1 wherein the uniform transverse cross-section of said central passage is between 40 and 80% of the predetermined width of said metallic strand.

3. The apparatus according to claim 1 wherein each burner is supplied by separate gas transporting conduits to effect mixing of the combustion fuel with the combustion supporting gas within the burner.

4. The apparatus according to claim 3 wherein the combustion of said fuel and gas is complete within the central passage so that there is maintained a reducing condition within the heating zone.

5. The apparatus according to claim 4 including a temperature sensing means, which means controls the flow of combustion supporting gas through one of said conduits.

6. The apparatus according to claim 5 including means to regulate the pressure differential between said combustion supporting gas and said combustion fuel.

7. The apparatus according to claim 6 including means to hold substantially constant the combustion support gas/combustion fuel ratio with changes in temperature monitored by said sensing means.

8. The apparatus according to claim 1 wherein each said burner panel is characterized by a single burner capable of heating substantially the full width of said metallic strand.

* * * * *